United States Patent [19]

Evans

[11] Patent Number: 4,462,230

[45] Date of Patent: Jul. 31, 1984

[54] CHANGEABLE SAFE DEPOSIT LOCK WITH SLIDABLE CLAMPED FENCES

[75] Inventor: Walter R. Evans, Lancaster, Ky.

[73] Assignee: Sargent & Greenleaf, Inc., Nicholasville, Ky.

[21] Appl. No.: 409,611

[22] Filed: Aug. 18, 1982

[51] Int. Cl.[3] ..... E05B 25/00

[52] U.S. Cl. ..... 70/383; 70/339; 70/355

[58] Field of Search ..... 70/383, 384, 382, 339, 70/337, 355

[56] References Cited

U.S. PATENT DOCUMENTS

| | | | |
|---|---|---|---|
| 701,231 | 5/1902 | Taylor | 70/383 |
| 953,641 | 3/1910 | Prindle | 70/384 |
| 960,421 | 6/1910 | Sibley | 70/383 |

*Primary Examiner*—Robert L. Wolfe

*Attorney, Agent, or Firm*—Mason, Fenwick & Lawrence

[57] ABSTRACT

A changeable safe deposit lock, usable in a single key or a double key configuration, having one or a pair of stacks of vertically slidable adjustable fences carried on a bolt plate and held in adjusted positions by a clamping assembly having a changing screw which is accessible at the back of the lock when the bolt plate is in unlocked position. After insertion of a key for which the lock is presently conditioned and rotation of the key to the unlocked condition, the screw may be loosened and the key rotated an additional distance whereby the initial key can be removed from the lock and a second key may be placed in the lock and rotated to return the bolt plate to the locked position and the changing screw tightened down to lock the fences in the new position adapted to the new key.

16 Claims, 6 Drawing Figures

CHANGEABLE SAFE DEPOSIT LOCK WITH SLIDABLE CLAMPED FENCES

BACKGROUND AND OBJECTS OF THE INVENTION

The present invention relates in general to key locks for use in safe deposit box applications and the like, and more particularly to safe deposit box key locks of either the single or double key type, wherein the lock mechanism for the renter key in the single key type, or for the renter key and guard key in the double key type, are capable of being changed in the field for different renter keys or different renter keys and guard keys.

It will be appreciated that safe deposit boxes and bank vaults and similar security installations are successively leased to different parties, to whom the lessor furnishes a renter's key adapted to open a given safe deposit box, in the single key lock application, or wherein the lessor furnishes a renter's key adapted to open a box after being partially operated or armed by a guard or prep key, in the dual key application. Often, lessees or renters fail to return the renter's key at the expiration of their lease, or the renter may lose the renter's key, and it becomes necessary in such cases to change the safe deposit key lock so that it can be operated by a renter's key bit having a different configuration. Also, even if the lessee or renter returns the renter's key at the expiration of his lease, it is desirable to change the key bit configuration to which the lock is responsive whenever the renter of the box is changed, to prevent the otherwise possible use of an unauthorized duplicate of the renter's key which may have been made before the renter's key was returned.

For this reason, certain safe deposit locks have been made in such a manner that the position of the gatings in the tumblers operated by the renter's key is changeable (or wherein the tumblers for both the renter's key and the guard key are changeable) so that the position of the gatings may be adjustably set to be opened by a different renter's key (or guard key). The typical practice in this regard has been to provide a change key in the form of a non-round cross-section rod which is insertable into an opening in the safe deposit lock case or rear cover wall and through shaped openings in the renter's key tumbler, when the safe deposit lock has been activated by the old renter's key. Typically, the tumblers have either been of the pivoted type or of the slide type. In the case of the pivoted type, the combination change key interfits into shaped openings in one of two pivoted companion tumbler sectors for each renter's key tumbler lever, to decouple normally mated tumbler lever sections from the key tumblers and permit them to recouple in a position corresponding to the configuration of the bit of the new renter's key. In the case of the slide tumbler type construction, clamping post type structures have been provided to normally clamp slidable key tumblers in various combination positions, and to permit selective release of the slidable key tumblers under predetermined circumstances to permit readjustment of their relative positions.

It has become recognized that it is also desirable to provide for the setting of the guard key or prep key tumbler lever system in accordance with different guard key or prep key configurations, so that the guard key to be used with safe deposit locks can be changed from time to time to provide greater security or reset the locks when the guard key is lost or when change of guard personnel occurs. Attempts to provide for changing the lock to accommodate different guard keys as well as different renter's keys have generally involved use of renter key tumbler levers which are either made-up of two pivoted companion tumbler sectors which may be selectively decoupled when the lock is in a change mode to permit relative adjustment of one of the tumbler sectors with respect to the other to accommodate the configuration of the bit of the new renter's key, and also using a entirely different set of guard key tumbler levers disposed in a portion of the lock housing spaced from the renter's key tumbler levers and a plurality of independently adjustable fence members associated with the guard key tumblers capable of being set to different positions to operate with different guard key configurations. Such a construction requires a considerably large space-consuming lock configuration and considerable increased complications and expense in the assembly of safe deposit locks.

An object of the present invention is the provision of a novel changeable safe deposit lock, usable in a single key or a double key configuration, wherein a changing screw is provided which must be loosened in the back of the lock after insertion of a key for which the lock is presently conditioned and rotation of the key to the unlocked condition, to allow the key to be rotated an additional distance so that the head of the changing screw becomes positioned in a different position above a shelf formation in the back of the lock case, whereupon, after removal of the initial key, a second key may be placed in the changing position slot, rotated to the forward direction to come to a physical stop, and the changing screw is then engaged with the case in the forward position where it can be tightened down to lock the fences in the new position adapted to the new key.

Other objects, advantages and capabilities of the present invention will become apparent from the following description, taken in conjunction with the accompanying drawings illustrating a preferred embodiment of the present invention.

DETAILED DESCRIPTION OF PREFERRED EMBODIMENTS

Figure 1:
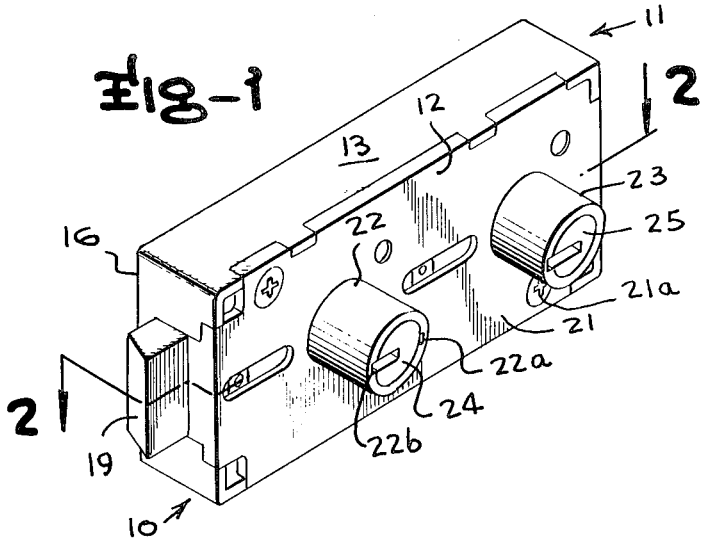
FIG. 1 is a front perspective view of a changeable safe deposit box lock embodying the present invention.
Figure 2:
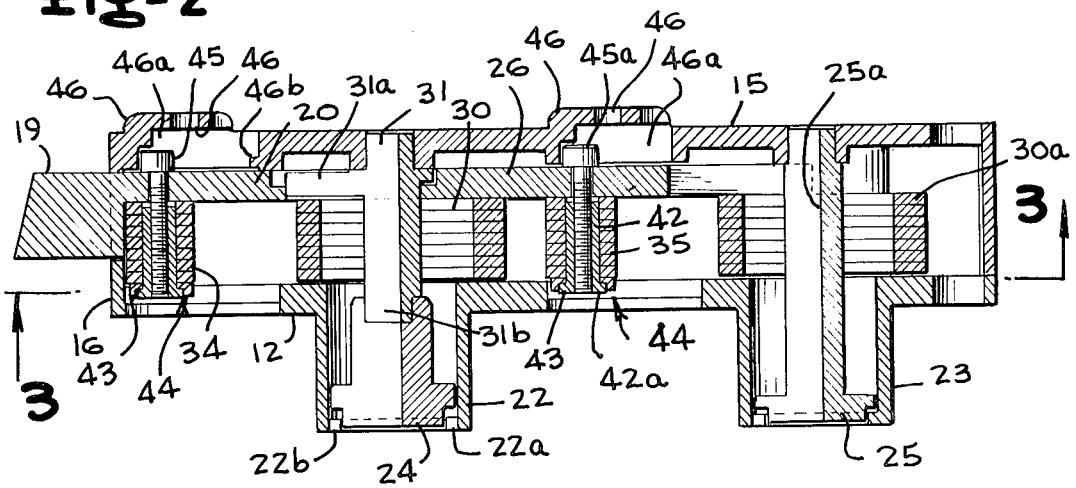
FIG. 2 is a horizontal longitudinal section view taken along the line 2—2 of FIG. 1.

Referring to the drawings, wherein like reference characters designate corresponding parts throughout the several figures, the key operated changeable safe deposit box lock of the present invention is shown in one form in FIGS. 1–5 as a double changeable lock, and is indicated generally by the reference character 10. The safe deposit lock 10 comprises a lock case 11 and a cover plate 12 assembled by screws with the case 11 to form a box-like enclosure for the lock mechanism. In accordance with conventional practice, the lock case 11 is a generally rectangular case or housing in the form of a forwardly opening box-like structure to be forwardly closed by the cover plate 12, and comprises parallel top and bottom walls 13,14, a rear wall 15, and end walls 16 and 17. The end wall 16 has an opening therethrough through which the locking bolt formation 19 integral and extending from the bolt plate 20 projects. The front cover plate 12 includes a front panel or wall 21 having screw holes for receiving screws 21*a* therethrough to be threaded into tapped formations on the top and bottom walls 13,14, for example as indicated at 14*a*, for assembling the cover plate 12 to the case 11.

The cover plate 12 has a pair of forwardly projecting horns or annular bosses 22,23, one of which serves as the horn for the renter's key, and the other which serves as the horn for the guard or prep key. In the illustrated embodiment, the horn 22 is the renter's key horn and the horn 23 is the prep key horn. These horns 22 and 23 serve as outwardly surrounding tubular bearings for hubs or plugs, indicated at 24 and 25, for the renter's key and guard or prep key respectively, and extend through customary circular openings provided therefor in the door of the conventional safe deposit box compartment or chamber. The corners of the lock case 11 are provided with the usual holes, as shown, extending therethrough for fastening bolts projecting into tapped openings in the conventional safe deposit compartment door to mount the assembled case and cover plate against the inner surface of the door.

The bolt plate member 20 includes the usual heavy bolt formation 19 in the form of a thick, generally rectangular block which projects form the lock case 11 through the wall 16 thereof into a conventional keeper recess in the locking or projected position of the bolt, and includes an integral thinner bolt plate portion 26 extending rearwardly through the major portion of the lock mechanism chamber of the lock casing and terminating in a generally U-shaped or bifurcated end portion defining vertically spaced upper and lower legs indicated at 26*a*,26*b*. The bolt formation 19 is guided by sliding engagement along its upper and lower edges with guide surfaces bounding the opening 16*a* in the end wall 16 and a horizontally elongated slot 26*c* in the intermediate portion of the bolt plate 26 as well as the cutout portion indicated at 26*a*' along the rearmost portion of the leg 26*a* are slidably guided by tumbler mounting posts 27,28 projecting integrally forwardly from the rear wall 15 of the case and forming the mounting posts for two packs of tumbler levers 30, 30*a*, forming respectively the renter key tumbler pack and the guard key tumbler pack. An opening 26*d* in the intermediate portion of the bolt plate 26 and an open formation 26*e* defined between the rearmost legs 26*a* and 26*b* are provided to respectively receive projection 31*a* of driving cam 31 coupled to plug 24 and a portion 25*a* of the plug 25 and end portions of the renter's key and guard key inserted in keyways of the plugs 24, 25 and portions 31*a*, 25*a*.

In the illustrated embodiment, the tumbler levers 30 and 30*a* are all of the same configuration and generally comprise a main body portion having a pivot opening 32 therein to receive the tumbler lever mounting post 27 or 28, and having a fence receiving gate 33 extending in confronting relation to packs of selectively adjustable slide fence members 34, 35 respectively associated with the tumbler lever packs 30, 30*a*, as hereinafter described. The tumbler levers 30, 30*a*, also include integral spring forming extensions 36 of known construction which bear upon the top or bottom wall, for example the bottom wall 14 in the il1ustrated embodiment, of the lock case to resiliently bias the tumblers 30, 30*a* about their respective tumbler posts 27, 28 to normally abut and assume a rest position against the smaller diameter rearwardly projecting cylindrical arbor portion 25*a* of the renter plug 25 and the shank portion 31*b* of the drive cam 31.

The fence members 34, 35 are generally L-shaped plates having a vertically elongated, generally rectangular thicker main body portion 39 and rearwardly projecting, fence forming foot portions 40 which, in the illustrated embodiment, are somewhat thinner then the rectangular body portions 39, and project horizontally in the direction of the gated portions of the tumbler levers 30, 30*a*. The main body portion 39 of the fence members 34, 35 has a vertically elongated slot 41 therein to receive two vertically spaced guide pins 26*h* and 26*i* projecting integrally forwardly from bolt plate 26 and accommodate therebetween, the generally cylindrical stem portion of a clamping post member 42 which is interlocked, as herein described, with a clamping flange portion 43 to form a clamp assembly 44 supporting the two packs of slidable fence members 34, 35 on the bolt plate. A bore extending through the clamping post portion 42 of the clamp assembly 44 is threaded to receive a clamp screw 45, which in this embodiment is an Allen head screw, having a shank portion extending through and journaled in appropriately sized openings in the bolt plate 26 and having an enlarged head 45*a* movable with the bolt in cavity formations 46*a* formed in the rear wall 15 of the lock case having tool apertures 46 therein for receiving an Allen head wrench or similar manipulating tool for the screw 45 to adjust the screw 45 when properly aligned with its associated tool opening 46. It will be noted from the drawings that the enlarged diameter head 42*a* of the clamping post 42 is of non-round, substantially rectangular configuration and a conforming recess 43*a* is provided in the clamping flange 43 shaped to conform to the head 42*a* so that the head 42*a* is received in nested relation in the recess 43 and held against rotation therein. Also, the clamping flange 43 is provided with an elongated slot 43*b* communicating with the recess 43*a* to receive the post 42 and alignment pins 26*h*, 26*i* which extend through the vertically elongated slots 41 in the rectangular body portions 39 of the fence members to maintain them in properly oriented vertically aligned relation.

In the normal condition of the lock, the clamp assembly 44 for both the pack of fence members 34 and the pack 35 will be in tightened clamping position holding the various fence members at vertical positions such that the foot portions 40 thereof are properly disposed to receive the gates of the associated renter's key tumbler levers 30 and/or guard key tumbler levers 30*a* when adjusted angularly about their pivot posts 27, 28 by the renter's key and/or guard key for which the slide fence members 34, 35 have been previously adjusted. When it is desired to change the renter key, the guard key must be inserted in the guard key plug 25 and rotated clockwise, viewed from the front, until it stops, thereby angularly adjusting the tumbler levers of the pack of tumbler levers 30*a* to proper relative angular positions so that their gates are aligned horizontally to receive the feet of the fence members 35. The renter's key is then inserted in the renter's key plug 24 and rotated clockwise to the stop position (which is the unlocked position), which retracts the bolt member 20 to unlocked position aligning the head 45*a* of the clamp changing screw 45 for the renter's key fences 34 with the tool opening 46 in the rear wall 15 of the case.

The change wrench (such as an Allen wrench) can then be inserted through the tool opening 46 into the socket of the changing screw 45 and rotated through the appropriate range to loosen the renter fence clamp changing screw 45. In this position, the feet 40 of the slide fence members 34 are all now inserted in the gates of the associated tumbler levers 30. Loosening of the changing screw 45 for the tumbler levers 30 positions the head of this changing screw 45 rearwardly of the shelf 46*b* formed on the back wall 15 of the case, permitting the bolt plate to retract an additional small distance (about 1/32") to enable the drive cam projection 32*a* to pass over a shoulder of opening 26*d* and allow the renter's key to be rotated an additional distance to further retract the bolt plate 26. This shelf 46*b* acts as a stop for the screw head 45*a* prior to loosening of the screw 45, but upon loosening of the screw, the screw head is positioned above the shelf 46*b* and thus allows the additional small extent of movement of the bolt plate allowing the renter's key to rotate further to be aligned with the key change slot 22*a* in the renter's key horn 22 so that the old renter's key can be withdrawn, and the new renter's key inserted and turned counterclockwise until it reaches the stop position. This angularly adjusts the tumbler levers 30 and thus vertically readjusts the fences 34 whose feet are interfitted in the gates of the tumbler levers 30, to positions corresponding to the contour of the new renter's key. The renter fence clamp screw 45 is then tightened to securely clamp the slide fence members 34 in the new key position. The renter's key can then be rotated to the locked position aligning it with the other slot 22*b* in the horn 22 whereupon it can be removed, and the guard key is then rotated to the locked position and removed.

The procedure for changing the guard key is similar, in that the guard key and renter's key are inserted in the appropriate plugs 24, 25 and rotated to the stop position, retracting the bolt plate 20 to the unlocked position, whereupon the change wrench is inserted through the opening 46 into the head of the change screw 45 for the guard key fence pack 35 and rotated to release those fence members. The guard key is then rotated back to locked position and withdrawn from the horn 23, the new guard key is inserted and rotated to unlocked position, the guard fence clamp screw 45 is then tightened, and the renter key is rotated to the locked position and removed.

Figure 3:
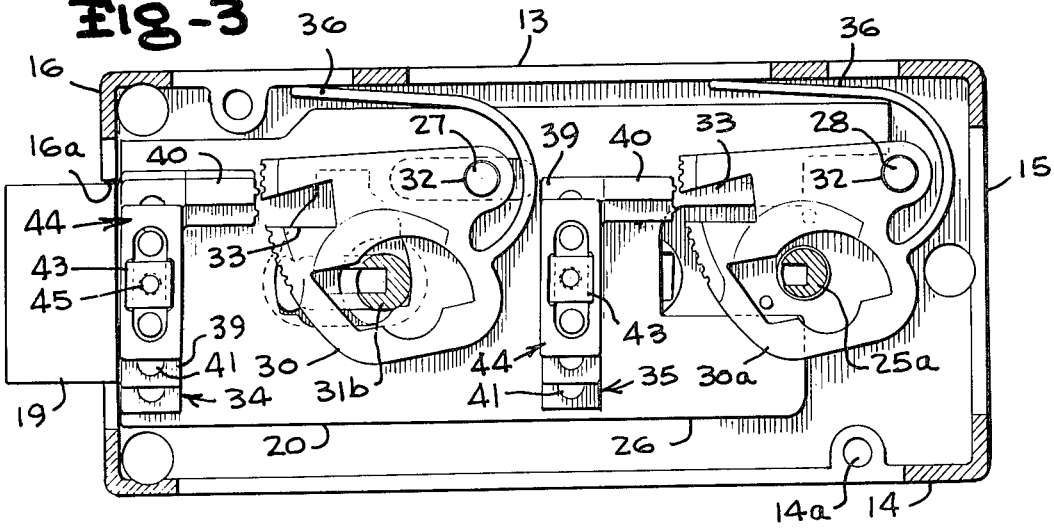
FIG. 3 is a vertical longitudinal section view taken along the line 3—3 of FIG. 2, showing the stacks of key operated tumbler levers in locking position and with the bolt extended.
Figure 4:
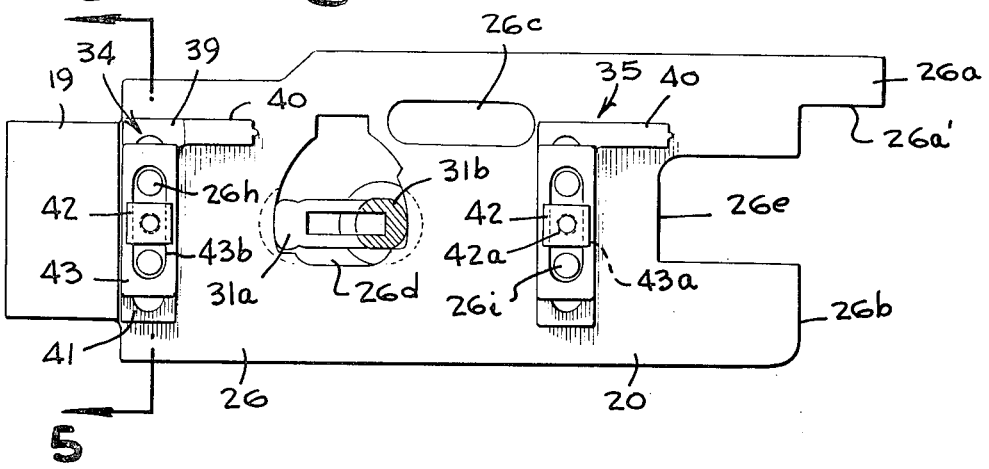
FIG. 4 is a rear elevation view of the bolt assembly with the clamp flange and post assemblies and stacks of fence members thereon, shown as a subassembly removed from the lock case.
Figure 5:
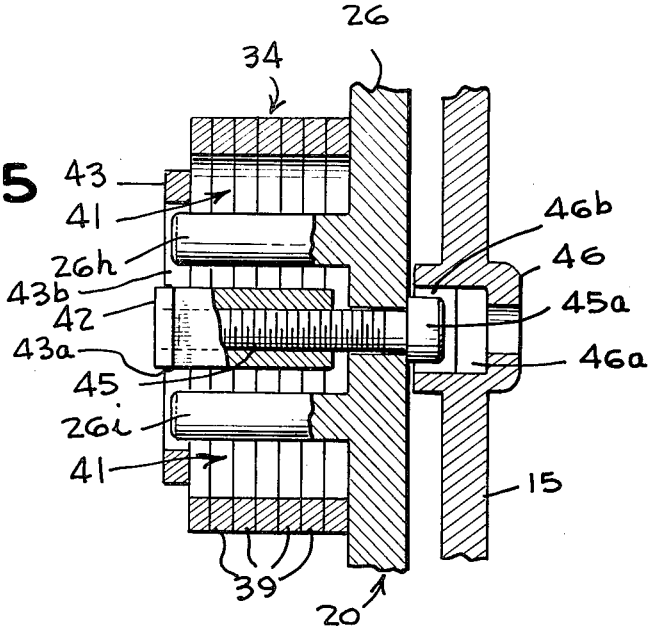
FIG. 5 is a fragmentary vertical section view through a stack of the fence members and adjacent parts of the rear wall, taken along line 5—5 of FIG. 4.
Figure 6:
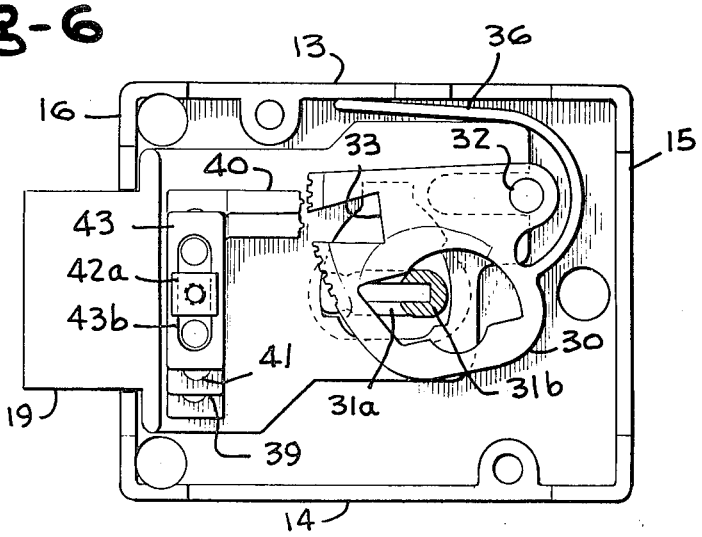
FIG. 6 is a view similar to FIG. 3 of a single key changebale lock modification.

There is also illustrated in FIG. 6 a section view similar to FIG. 3, showing the components of a single changeable safe deposit lock embodying the features of the double changeable safe deposit lock previously described, but wherein only the renter's key can be changed (there being no guard key in this embodiment). In the embodiment of FIG. 6, the lock case components, the renter's key horn and plug, the stack of renter's key tumbler levers and the associated renter's key slide fence members and clamp assembly are indicated by reference characters corresponding to those used in describing the preceding embodiment. Operation of the single changeable safe deposit lock shown in FIG. 6 will be readily understood from the description of the double changeable embodiment of FIGS. 1–5, except that no guard key or associated tumbler levers and fence members are involved.

I claim:

1. A changeable combination key lock comprising a lock case defining a generally box-like enclosure having front and rear vertical walls, a bolt plate slidably movable adjacent one of said walls between projected locking and retracted unlocking positions having a stack of fence members carried thereon each having a generally rectangular vertically elongated body portion and a horizontally extending foot portion projecting therefrom, a stack of peripherally gated pivoted tumbler levers occupying positions in the locked condition of the lock to bar retraction of said fence members and said bolt plate from the projected locking position and movable responsive to a key to adjust the gating recesses to accommodate said foot portions of said fence members to permit retraction of the bolt to unlocking position, a rotatable key receiving member for insertion of a key therein into engagement with said tumbler levers for adjusting them to align their gating recesses with the feet of the fence members for unlocking retraction of the bolt, the bolt plate having a shaped opening therein, a driving cam associated with said key receiving member to be rotated by the key and having a projection located in said shaped recess for moving the bolt plate between said locking and unlocking positions, means extending from said bolt plate supporting the fence members of the stack for vertically guided adjustment to positions corresponding to a predetermined range of key shapes, a fence clamping assembly comprising a clamping member including a flange portion to overlap the face of stack of fence members opposite said bolt plate and a clamping screw coupled to said clamping member and said bolt plate to clamp the fence members in fixed positions against said bolt plate when the screw is in tightened fence clamping position, one of said vertical walls having means receiving a head portion of said clamping screw accommodating movement of the bolt plate and head through a predetermined first range from the locking to unlocking position and having a stop shelf formation located to abut the clamping screw head at the unlocking position of the bolt plate, said stop shelf and clamping screw head being shaped to accommodate a short extent of additional retracting movement of the bolt plate to a key change position when said clamping screw is rotated to a fence releasing position and the bolt plate occupies the unlocking position, said bolt plate opening being shaped to accommodate key rotation to a key change position allowing retraction of the key from the key plug with the fence members released for vertical adjustment and allowing insertion of a new key into the key plug to adjust the tumbler levers and the fence members interfitted therein to new positions corresponding to the new key configuration upon rotation of the new key to the unlocking position of the bolt plate, whereupon rotation of the clamping screw to return to clamping position fixes the fence members in the new key position.

2. A changeable combination key lock as defined in claim 1, wherein said rear wall has a forwardly facing recess therein accommodating said clamping screw head therein throughout the range of movement of the screw head with the bolt plate between locking and unlocking positions with the clamping screw head either in clamping position or fence releasing position, and said rear wall having an opening therethrough communicating with said recess and aligned with said clamping screw head when the bolt plate is in the unlocking position to receive a tool therethrough for rotating the clamping screw to clamping and release positions.

3. A changeable combination key lock as defined in claim 2, wherein said rear wall has a rearwardly extending bulge therein defining said recess for the clamping screw head and having said tool opening therethrough.

4. A changeable combination key lock as defined in claim 1, wherein said body portions of said fence members each have a vertically elongated slot therein, said bolt plate includes a pair of rigid guide pins projecting forwardly therefrom through said vertically elongated slots for supporting the fence members for vertically guided adjustment through their range of positions, and said clamping member including an internally threaded post portion assembled with said flange portion and extending rearwardly through said slots between said guide pins having threaded portions of the clamping screw extending forwardly through said slots from said clamping screw head and between said guide pins.

5. A changeable combination key lock as defined in claim 2, wherein said body portions of said fence members each have a vertically elongated slot therein, said bolt plate includes a pair of rigid guide pins projecting forwardly therefrom through said vertically elongated slots for supporting the fence members for vertically guided adjustment through their range of positions, and said clamping member including an internally threaded post portion assembled with said flange portion and extending rearwardly through said slots between said guide pins having threaded portions of the clamping screw extending forwardly through said slots from said clamping screw head and between said guide pins.

6. A changeable combination key lock as defined in claim 3, wherein said body portions of said fence members each have a vertically elongated slot therein, said bolt plate includes a pair of rigid guide pins projecting forwardly therefrom through said vertically elongated slots for supporting the fence members for vertically guided adjustment through their range of positions, and said clamping member including an internally threaded post portion assembled with said flange portion and extending rearwardly through said slots between said guide pins having threaded portions of the clamping screw extending forwardly through said slots from said clamping screw head and between said guide pins.

7. A changeable combination key lock as defined in claim 1, wherein said fence members are of L-shaped configuration wherein the vertical leg thereof forms said body portion and said foot portion extends horizontally from the lower end of said body portion toward the gated peripheries of said tumbler levers, the gates of the tumbler levers being scrambled out of alignment with said foot portions in their locked condition and being key positioned to align their gates to receive said foot portions interfitted therein in the unlocked condition of the lock.

8. A changeable combination key lock as defined in claim 4, wherein said fence members are of L-shaped configuration wherein the vertical leg thereof forms said body portion and said foot portion extends horizontally from the lower end of said body portion toward the gated peripheries of said tumbler levers, the gates of the tumbler levers being scrambled out of alignment with said foot portions in their locked condition and being key positioned to align their gates to receive said foot portions interfitted therein in the unlocked condition of the lock.

9. A changeable combination key lock for safe deposit boxes and the like, comprising a lock case defining a generally box-like enclosure adapted to be mounted on a safe deposit box door and having a vertical rear wall to be spaced rearwardly from the door in the mounted position of the lock case, a locking bolt member including an integral bolt plate slidably movable in said case between projected locking and retracted unlocking positions with said bolt plate located forwardly adjacent said wall and having two stacks of fence members carried thereon each having a generally rectangular vertically elongated body portion and a horizontally extending foot portion projecting therefrom, two stacks of peripherally gated tumbler levers each pivotally supported about a pivot axis occupying positions in the locked condition of the lock disposing the gated peripheries of the tumbler levers in the path of longitudinal unlocking movement of said fence members to bar retraction of said fence members and said bolt plate from the projected locking position and movable responsive to a key to adjust the gating recesses to accommodate said foot portions of said fence members to permit retraction of the bolt to unlocking position, a rotatable guard key plug and a rotatable renter's key plug for insertion of a guard key and renter's key respectively therein into engagement with respective sets of said tumbler levers for adjusting them to align their gating recesses with the feet of the associated fence members for unlocking retraction of the bolt, the bolt plate having a shaped opening therein, a driving cam associated with the renter's key plug to be rotated by the renter's key and having a projection located in said shaped recess for moving the bolt plate between said locking and unlocking positions, pairs of guide pins carried by and projecting from said bolt plate through said vertically elongated slots in the body portions of respective sets of fence members supporting the fence members of the stacks for vertically guided adjustment through a range of positions corresponding to a predetermined range of key shapes, a clamping member for each fence stack including a flange portion to forwardly overlap the respective stacks of fence members having an internally threaded socket, a clamping screw for each stack threaded into the socket of the associated flange portion and extending through the slots of the fence members parallel to and between said guide pins and each screw having a head projecting a predetermined short distance rearwardly from said bolt plate when the screw is in tightened fence clamping position, said rear wall having a recess for each clamping screw head accommodating movement of the bolt plate through a predetermined first range from the locking to unlocking position, the recess for the screw head for the renter's key fence stack having a stop shelf formation located to abut the clamping screw head at the unlocking position of the bolt plate, said stop shelf and clamping screw head being shaped to accommodate a short extent of additional retracting movement of the bolt plate to a renter's key change position when said clamping screw is rotated to a fence releasing position and the bolt plate occupies the unlocking position, said bolt plate opening being shaped to accommodate renter's key rotation to a key change position allowing retraction of the renter's key from the renter's key plug with the fence members therefor released for vertical adjustment and allowing insertion of a new renter's key into the renter's key plug to adjust the associated tumbler levers and the fence members interfitted therein to new positions corresponding to the new renter's key configuration upon rotation of the new renter's key to the unlocking position of the bolt plate, whereupon rotation of the clamping screw to return to clamping position fixes the renter's key fence members in the new renter's key position.

10. A changeable combination key lock as defined in claim 9, wherein said rear wall has a pair of forwardly facing recesses therein accomodating the heads of said clamping screws therein throughout the range of movement of the screw heads with the bolt plate between locking and unlocking positions with the clamping screw heads either in clamping position or fence releasing position, and said rear wall having an opening therethrough communicating with each said recess and aligned with said clamping screw heads when the bolt plate is in the unlocking position to receive a tool therethrough for rotating either of the clamping screws to clamping and release positions.

11. A changeable combination key lock as defined in claim 10, wherein said rear wall has a pair of rearwardly extending bulges therein defining said recesses for the clamping screw heads and having said tool openings therethrough.

12. A changeable combination key lock as defined in claim 9, wherein said body portions of said fence members each have a vertically elongated slot therein, said bolt plate includes pairs of rigid guide pins projecting forwardly therefrom through said vertically elongated slots for supporting the fence members for vertically guided adjustment through their range of positions, and said clamping member for each fence stack including an internally threaded post portion assembled with said flange portion and extending rearwardly through said slots between said guide pins having threaded portions of the associated clamping screw extending forwardly through said slots from its clamping screw head and between said guide pins.

13. A changeable combination key lock as defined in claim 10, wherein said body portions of said fence members each have a vertically elongated slot therein, said bolt plate includes pairs of rigid guide pins projecting forwardly therefrom through said vertically elongated slots for supporting the fence members for vertically guided adjustment through their range of positions, and said clamping member for each fence stack including an internally threaded post portion assembled with said flange portion and extending rearwardly through said slots between said guide pins having threaded portions of the associated clamping screw extending forwardly through said slots from its clamping screw head and between said guide pins.

14. A changeable combination key lock as defined in claim 9, wherein said fence members are of L-shaped configuration wherein the vertical leg thereof forms said body portion and said foot portion extends horizontally from the lower end of said body portion toward the gated peripheries of the associated tumbler levers, the gates of the tumbler levers being scrambled out of alignment with said foot portions in their locked condition and being key positioned to align their gates to receive said foot portions interfitted therein in the unlocked condition of the lock.

15. A changeable combination key lock as defined in claim 12, wherein said fence members are of L-shaped configuration wherein the vertical leg thereof forms said body portion and said foot portion extends horizontally from the lower end of said body portion toward the gated peripheries of the associated tumbler levers, the gates of the tumbler levers being scrambled out of alignment with said foot portions in their locked condition and being key positioned to align their gates to receive said foot portions interfitted therein in the unlocked condition of the lock.

16. A changeable combination key lock as defined in claim 13, wherein said fence members are of L-shaped configuration wherein the vertical leg thereof forms said body portion and said foot portion extends horizontally from the lower end of said body portion toward the gated peripheries of the associated tumbler levers, the gates of the tumbler levers being scrambled out of alignment with said foot portions in their locked condition and being key positioned to align their gates to receive said foot portions interfitted therein in the unlocked condition of the lock.

* * * * *